US008727834B2

(12) United States Patent
Schneider et al.

(10) Patent No.: US 8,727,834 B2
(45) Date of Patent: May 20, 2014

(54) DEVICE AND A METHOD FOR POLISHING LENSES

(75) Inventors: Gunter Schneider, Marburg (DE); Helwig Buchenauer, Dautphetal-Buchenau (DE); Stephan Huttenhuis, Marburg (DE); Frank Flesch, Dillenburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 782 days.

(21) Appl. No.: 12/657,082

(22) Filed: Jan. 13, 2010

(65) Prior Publication Data

US 2010/0190415 A1 Jul. 29, 2010

(30) Foreign Application Priority Data

Jan. 13, 2009 (DE) ..... 10 2009 004 787

(51) Int. Cl.
*B24B 1/00* (2006.01)

(52) U.S. Cl.
USPC ..... 451/42; 451/146; 451/255; 451/290

(58) Field of Classification Search
USPC ..... 451/42, 285–290, 146, 158, 254–256, 451/258
See application file for complete search history.

(56) References Cited

U.S. PATENT DOCUMENTS

| | | | | |
|---|---|---|---|---|
| 2,005,718 | A * | 6/1935 | Desenberg | 451/42 |
| 4,989,316 | A * | 2/1991 | Logan et al. | 29/527.3 |
| 5,042,935 | A * | 8/1991 | Logan et al. | 351/159.01 |
| 5,341,604 | A * | 8/1994 | Wood | 451/5 |
| 6,733,369 | B1 * | 5/2004 | Stacklies et al. | 451/42 |
| 6,945,849 | B2 * | 9/2005 | Miyazawa | 451/11 |
| 7,448,942 | B2 * | 11/2008 | Miyazawa | 451/41 |
| 7,503,834 | B2 * | 3/2009 | Kuebler et al. | 451/42 |
| 2004/0229553 | A1 * | 11/2004 | Bechtold et al. | 451/42 |
| 2007/0173176 | A1 * | 7/2007 | Kiontke et al. | 451/5 |
| 2009/0163118 | A1 * | 6/2009 | Kuebler et al. | 451/42 |

* cited by examiner

*Primary Examiner* — Maurina Rachuba
(74) *Attorney, Agent, or Firm* — Hudak, Shunk & Farine Co. LPA

(57) ABSTRACT

A method for polishing lens surfaces, in which a) prior to the polishing process, for the purpose of determining an abrasion profile, at least one point of a workpiece is polished by means of a polishing tool to be used, using at least one pre-defined parameter; b) the polishing abrasion thus achieved on the workpiece side is determined by measuring; c) on the basis of the abrasion profile, at least one parameter is set for a subsequent polishing process, and the polishing process is completed at least partially. A method for polishing lens surfaces, in which the polishing point is places at least outside of the workpiece center at a distance a from a plane which is tensioned by the tool spindle axis and the workpiece spindle axis. The invention furthermore relates to a lens polishing machine in which at least one movement axis is provided, by means of which a distance a between the polishing point and a plane which is tensioned by the tool spindle axis and the workpiece spindle axis can be set and/or changed.

12 Claims, 3 Drawing Sheets

DEVICE AND A METHOD FOR POLISHING LENSES

FIELD OF THE INVENTION

The invention relates to a method for polishing lens surfaces, in which a polishing area of a polishing head which rotates around a tool spindle axis is guided over the lens surface of a workpiece which is to be polished, wherein the polishing area and the lens surface are in contact only in a partial section, the polishing point, and at least one parameter is set for this polishing process. The following variables are feasible as parameters for the polishing process: the rotational speed of the polishing head, the rotational speed of the workpiece, i.e. the relative speed, the position of the polishing point (contact point) on the polishing area of the polishing head, the position of the polishing point (contact point) on the lens surface, the polishing pressure or polishing force, the relative position between the polishing point, tool axis and workpiece axis, in particular the direction and level of the relative speed or movement vector V from tool to workpiece and/or the degree or time progression of the change in one or more pre-specified variables during the polishing process.

Furthermore, the invention relates to a method for polishing lens surfaces in which a polishing surface of a polishing head which rotates around a workpiece spindle axis is guided over the lens surface which is to be polished of a workpiece which rotates around a workpiece spindle axis, wherein the tool and the workpiece are only positioned against each other in a partial section, the polishing point P.

Finally, the invention relates to a lens polishing machine with a polishing spindle which comprises a workpiece spindle axis, for holding a polishing head which can be rotationally driven via the workpiece spindle axis, and with a workpiece spindle comprising a workpiece spindle axis for holding a lens to be polished, wherein the polishing head and a lens surface of the lens can only be brought into position against each other in one polishing point P.

BACKGROUND OF THE INVENTION

In lens technology, a differentiation is made between two areas of application and two categories of lens: optics, for which lenses made of mineral glass with spherical surfaces are usually used, and spectacles, for which lenses made of synthetic material with aspherical and non-rotationally symmetrical surfaces are usually used. The latter surfaces are polished using a polishing head with a zonally effective polishing method due to the lack of rotational symmetry, by contrast to which the spherical surfaces of the mineral glass lenses are polished all over with a polishing tool which has the required sphere. Additionally, it is provided that the spherical surfaces of the mineral glass lenses are polished zonally for the purpose of correcting the overall polishing procedure. For this purpose, a polishing head with a flexible polishing surface is usually used which serves to polish local ridges.

A method for polishing an aspherical, rotationally symmetrical surface of a lens by means of a tool which rotates around a tool axis is already known from DE 10 2004 047 563 A1. The workpiece is contacted in an area of a workpiece surface by an area which contacts it momentarily in each case, which is at least one partial area of an area to be machined, which is itself a partial area of a polishing area of the tool, wherein the tool axis penetrates a polishing area and the position of the tool is set in such a manner that the centre of the area of the tool which contacts the workpiece momentarily in each case (the polishing point) lies to the side of the tool axis.

Here, it is provided that a tool with an even polishing area is tipped depending on a surface perpendicular of the workpiece in the area which is contacted, around an axis which differs from the tool axis, wherein the tool axis is aligned parallel to the surface perpendicular, and the tool is displaced parallel a workpiece surface in the area which is contacted. In the outer areas of the workpiece, i.e. outside the centre, the polishing capacity is controlled via the rotational speed. A variation of the radius of the polishing point on the tool side is not provided when machining the outer areas of the workpiece.

With reference to a section plane S which comprises the polishing point, the polishing point and the two section points SW and SL lie between the tool axis and the section plane S and between the workpiece axis and the section plane S on a straight line. Accordingly, the polishing point lies in the plane E which is tensioned by the tool axis and the workpiece axis.

A polishing device is known from EP 1 384 553 A2. This comprises a polishing head with a rotational axis, a pivot axis which is arranged at right angles to it, and a further pivot axis which is arranged vertically to both aforementioned axes. The polishing head can thus be rotated around all three spatial axes. On the workpiece side, a rotational axis is also provided. The polishing point, which can be generated, can thus be placed on the tool side decentrally to the rotational axis of the polishing head.

With reference to a section plane S which comprises the polishing point, the polishing point and the two section points SW and SL are in contact between the tool axis and the section plane S, and between the workpiece axis and the section plane S, or on a connecting straight line G, i.e. the straight line G passes through the polishing point. The polishing point comprises no distance a to the straight line G. When the tool axis and the workpiece axis tension a plane E, the polishing point lies in the centre on this plane E, or centrally to the straight line G. In this case, the polishing point also comprises no distance a to the plane E or to the straight line G.

SUMMARY OF THE INVENTION

The object of the invention is to design a polishing method for polishing optically effective lens surfaces in such a manner that a polishing abrasion which is as defined as possible is guaranteed, and with a polishing capacity which is overall as low as possible, the best possible polishing result is achieved.

The object is attained according to the invention by means of a method, and by means of a lens polishing machine according to the claims.

For the polishing head, or type of polishing head, selected by the user, an abrasion profile for the polishing capacity or polishing abrasion thus to be attained for it is calculated experimentally, so that the anticipated polishing capacity or polishing abrasion is known for subsequent polishing processes with this type of polishing head, at least for the parameters used. The required polishing abrasion or polishing capacity can thus be set to a high degree of precision and reproduced. For this purpose, prior to the polishing process and in order to determine the abrasion profile, at least one partially circular polishing zone PL of a workpiece of the type of workpiece or lens to be used is polished by means of a polishing tool of a polishing tool type to be used and a polishing agent type, applying at least one parameter, or different pre-defined parameters. Then, the polishing abrasion which is thus achieved on the workpiece side is determined using measurements, from the polishing abrasion, an abrasion profile or abrasion characteristic is determined, and on the basis of the abrasion profile, at least one parameter, or the parameters, are set for a subsequent polishing process. Subsequently, the required polishing process can be at least partially completed, wherein the required polishing capacity can be highly precisely set due to the determined abrasion profile for the polishing head type used, and for the lenses to be polished on the basis of the method or fundamental principles described below. The recording of measurements preferably includes the measurement of the height and width or of the diameter of the polished zone of the workpiece or lens surface.

The rotationally symmetrical lens surface can be polished with a rotationally symmetrical polishing tool. The polishing point (contact area) between the lens and the polishing tool can here lie in the centre of the polishing tool or also with radius PW at any point on the polishing area of the polishing tool. The projection of the rotationally symmetrical lens surface to be polished is assumed below to be lying on the X-Y plane of a Cartesian coordinate system. A change in the height of the area then corresponds to a change in the Z direction.

The polishing tool is then guided over the lens surface in such a manner that with an infinitely small polishing point, the tool spindle axis runs parallel to the perpendicular in the polishing point on the lens surface.

The calculation of the abrasion profile or dwell time profile or feed profile of the polishing tool is then made on the basis of the following assumptions:

- The abrasion characteristic at one point on the lens is proportionate to the relative speed between the lens surface and the polishing area of the tool at this point
- The abrasion characteristic at a point on the lens is proportionate to the force which the polishing tool applies in this point to the lens surface
- The characteristic of the polishing tool is approximated to that of an ideal spring, i.e. the immersion depth on the tool side is proportionate to the application force which normally acts in the polishing point.

Initially, the surface projected onto the X-Y plane is dissected into n equidistant circular rings. The circular rings are in turn dissected into na circular ring segments. The number of circular rings_n is here selected in such a manner that with the same circular ring width, a sufficient number of circular rings m can be distributed on the polishing tool diameter.

Now the polishing tool, with the polishing point (rPj) with the radius on the tool side or distance_rPj between the polishing point and the centre of the polishing tool, on a circular ring, is brought into contact with the radius_rLi=X, and is immersed by a degree_d. Then, on the basis of the local geometry of the lens and the polishing tool in dependence on the immersion depth d, the force distribution of the circular ring elements which are in contact is determined. Here, initially, a random spring constant_k is used. Then, the relative speed between the polishing tool and the lens is calculated for each circular ring element which is in contact. This is now conducted taking into account the size of the area on the lens which corresponds to the corresponding circular ring segment on the X-Y plane. Due to the fact that the lens moves along below the polishing tool nL*t_times, depending on the torque_nL in the time_t, from the variables determined thus far, the relative speed and polishing force for each circular ring segment, a two-dimensional local abrasion profile or abrasion rate for the circular rings of the lens with a fixed position of the polishing tool for a dwell time_t, and for rLi, rPj, nL, nP and d, wherein the polishing point comprises a maximum width of m_circular rings. Here, nP is the torque of the tool and d is the immersion depth of the polishing tool.

Now the above calculation is repeated for all possible polishing points (rLi) on the workpiece side with the radius or distance_rLi on the lens. Thus, n local abrasion profiles=f(t, rLi, rPj, nL, nP, d, k) are obtained.

The model described above thus far contains the kinematic and geometric properties of the process. On the assumption that the abrasive properties of the polishing agent and the material properties of the polishing tool can be described by the spring constant_k still randomly selected above, this is now determined by comparing a local abrasion profile determined experimentally with n measuring positions_xs for a time_ts in comparison with that theoretically calculated with n(xs).

With the spring constant_k thus gained experimentally for this process, the n local abrasion profiles now result which are relevant to the calculation.

The determination of a dwell time profile for a global abrasion function for a movement along the X axis (radial movement) over the n_circular rings of the lens can now be determined with the aid of the time standardised local abrasion functions by means of a minimisation method.

Advantages of the model:

- The model takes into account the kinematics and the geometry of the process
- The abrasive properties of the polishing agent which can theoretically only be recorded with difficulty, and the material properties of the polishing tool, are traced back to the spring constant_k of the polishing tool, and are obtained from an experimentally determined local abrasion profile.

Thus, the model provides any dwell time profile required from just one experimentally determined local abrasion profile.

According to the invention, the polishing point P is placed at least outside of the centre of the workpiece at a distance a to a straight line G which connects the tool spindle axis and the workpiece spindle axis, wherein the straight line G and the polishing point P are arranged on a shared plane S. When the tool spindle axis and the workpiece spindle axis tension a plane E, the distance a relates to the plane E which is tensioned by the tool spindle axis and the workpiece spindle axis. The distance a guarantees a polishing process with a movement vector V which runs in the radial direction to the workpiece. Since the lenses to be polished are usually machined in the circumferential direction during manufacture, the movement vector V of the polishing tool, which according to the invention is aligned in the radial direction, guarantees an optimum polishing result. A reinforcement of the grooves or scores to be polished is prevented by the radial polishing movement. When the distance a of the polishing point, which is usually bordered by a round, oval or ring-shaped line, is determined, a set-down is to be made on the geometric centre of the polishing point or alternatively, on the edge of the polishing point. The section plane S comprises both with the tool spindle axis and with the workpiece spindle axis a section point SW or SL, wherein the polishing point P is arranged at a distance a in relation to the connecting straight line G contained in the section plane S of the two section points SW and SL.

For this purpose, it can also be advantageous when on the tool side, a movement vector V of the polishing movement is set, and i) at least one direction component of the movement vector V runs in the radial direction to the workpiece or to the lens, and/or ii) the direction of the movement vector V is varied during the polishing process. For the purpose of varying the polishing capacity, a variation of the movement vector V is helpful, in particular when the rawness of the lens surface originating from the grooves and scores varies according to the alignment.

The tool and the workpiece preferably turn in the same direction, so that when the polishing zone PW or its radius RW on the tool side is reduced in size, and when the size of the polishing zone PL or its radius RL is reduced on the workpiece side, a clear reduction of the polishing capacity to be applied ensues.

Due to the fact that according to the invention, the polishing point P is guided on the tool side during the polishing process in the radial direction from outwards to inwards, or from inwards to outwards, the polishing point P runs in spiral form from the edge area inwards towards the tool spindle axis, or vice-versa. Thus, the polishing capacity can be varied by changing the radius RW of the polishing point P. At the same time, the polishing area of the polishing head is almost completely and evenly utilised in relation to the polishing area, which guarantees the reproducibility of the polishing process with a defined polishing abrasion. Thus, a radius RW of the polishing point or the polishing zone PW is changed on the tool side. The radius RW varies between 1% and 100% of the tool radius or polishing head radius. The polishing point P can be guided over the length of the tool radius either constantly or inconstantly, i.e. the radius RW can also be constantly or inconstantly changed during the polishing process within the aforementioned % range, or maintained at a constant for certain periods of time.

Alternatively, on the tool side, the size of the radius R of the lens can be selected as the maximum radius RW of the polishing zone PW. Thus, the polishing point completes almost the same radius RW or RL on the tool side and on the workpiece side, i.e. from the edge into the centre of the lens, or almost to the tool spindle axis. When the radius RW or RL remains the same, the reproducibility of the polishing abrasion or polishing process can be improved.

Accordingly, it can be advantageous when the polishing point P is guided in the radial direction from the outside inwards towards the centre of the workpiece on the workpiece side during the polishing process. The polishing point P in this case runs spirally inwards from the edge area towards the centre of the workpiece. Here, a radius RL of the polishing point is smaller on the workpiece side. Since the workpiece is usually completely machined, the radius RL of the polishing point moves over the entire workpiece radius.

The polishing capacity required on the lens surface grows with the radius on the workpiece side, so that the outer area of the lens is machined using a large radius on the tool side. The further the polishing point moves into the centre of the lens, or the smaller the radius RL of the polishing zone on the workpiece side, the smaller the radius RW of the polishing zone is selected on the tool side. Thus, on the one hand, the polishing capacity is distributed over almost the entire tool area or polishing area. On the other, the polishing capacity is reduced towards the centre of the lens, since the polishing capacity reduces with the decreasing radius RW (with the same torque of the polishing head and the same polishing pressure). The centre of the lens can thus be machined with a lower polishing capacity, since a different polishing zone of the polishing head with a smaller radius RW is used, without having to change the torque of the polishing head or the polishing pressure.

It can be of particular significance for the invention when the direction of the movement vector V is set in the polishing point P on the tool side in such a manner that it runs in the radial direction to the workpiece from the inside outwards. Thus, in particular when machining the outer zone of the lens surface, the polishing agent which is applied in the area of the centre onto the lens surface to be polished, or onto the polishing area, is in addition to the centrifugal force guided outwards towards the polishing point P through the polishing movement on the tool side. The polishing capacity to be obtained is thus maximised.

In connection with the design of the lens polishing machine according to the invention, it is advantageous when at least one movement axis B1 is provided, by means of which a distance a of the polishing point P to a straight line G which connects the tool spindle axis and the workpiece spindle axis can be set and/or changed, wherein the straight line G and the polishing point P are arranged on a shared plane. When the tool spindle axis and the workpiece spindle axis tension a plane E, the distance a relates to the plane E which is tensioned by the tool spindle axis and the workpiece spindle axis. When determining the distance a, set-down is made on the edge of the polishing point or the contact point. When a distance a is set, the movement vector V of the polishing head can be set in such a manner that it comprises at least one direction component radial to the lens. Thus, an improvement in the polishing result ensues, since grooves and scores which run in the circumferential direction in particular are polished in a direction transverse to it.

The section plane S comprises both with the tool spindle axis and the workpiece spindle axis a section point SW or SL, wherein the polishing point P is arranged at the distance a in relation to the connecting straight line G on the section plane S of the two section points SW and SL.

For this purpose, it can be advantageous when the movement axis B1 is designed as a translation axis, and a further movement axis B2 which is deigned as a pivot axis is provided, which encloses a right-angle with a with a direction portion, wherein the movement angle B1 and/or B2 comprise a direction portion at right-angles to the workpiece spindle axis. The movement axis B1 can also be designed as a pivot axis with a translation portion.

It can also be advantageous when a further movement axis B3 is provided, which is designed as a translation axis, which comprises a direction portion which encloses a right-angle with the movement axis B1 and/or with the movement axis B2, wherein the movement axis B3 comprises a direction portion parallel to the workpiece spindle axis. The movement axis B3 can also be designed as a pivot axis with translation portion.

Here, it can be advantageous when by means of the movement axis B1, B2 and/or B3, the distance a can be set independently of a position on the tool side of the polishing point P. The position of the polishing point on the tool side, i.e. the radius RW of the polishing point or polishing zone, can be selected independently of the setting or variation of the distance a. Thus, the parameters of the polishing process can be selected according to the required polishing process.

BRIEF DESCRIPTION OF THE DRAWINGS

Further advantages and details of the invention are explained in the patent claims and in the description, and shown in the drawings, in which:

DETAILED DESCRIPTION OF INVENTION

Figure 1:
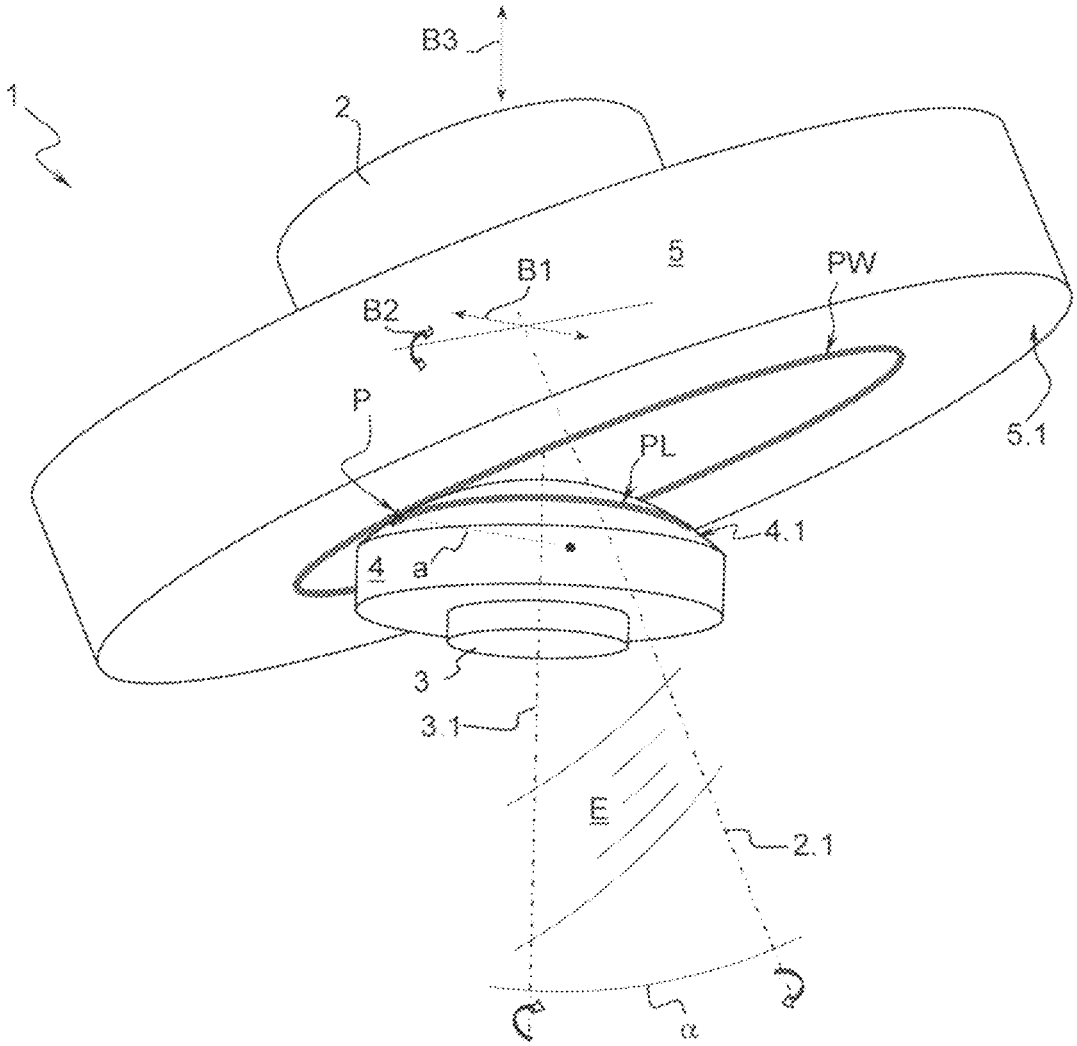
FIG. 1 shows a schematic diagram of the lens polishing machine.

The lens polishing machine 1 shown schematically in FIG. 1 comprises polishing spindle 2 with a polishing head 5 arranged thereon and a workpiece spindle 3 with a workpiece or a lens 4 arranged thereon. Both the polishing head or polishing tool 5 and the lens 4 are freely interchangeable.

The polishing head 5 can be rotated around a tool spindle axis 2.1, while the workpiece spindle 3 can be rotated with the lens 4 around a workpiece spindle axis 3.1. In order to guarantee a polishing process, the polishing head 5 lies with its polishing surface 5.1 in the polishing point P against a lens surface 4.1 of the lens 4. Due to the fact that both the polishing head 5 and the lens 4 rotate around the tool spindle axis 2.1 or workpiece spindle axis 3.1, a circular ring-shaped polishing zone PW is created on the polishing surface 5.1 and a polishing zone PL which is also circular ring-shaped is also created on the lens surface 4.1. A prerequisite for this is that both on the tool side and on the workpiece side, a radius RW or RL of the polishing point P is not changed.

In order to vary the radius RW on the tool side of the polishing zone PW on the one hand, and to vary the radius RL of the polishing zone PL on the workpiece side on the other, the polishing spindle 2 comprises three movement axes B1, B2, B3. The movement axis B3 is designed as a translation axis, and runs parallel to the workpiece spindle axis 3.1. The movement axis B1 is also designed as a translation axis, and runs at right-angles to the translation axis B3. The movement axis B2 is designed as a pivot axis and encloses a right-angle with both the movement axis B3 and the movement axis B1.

In the position shown in FIG. 1, the workpiece spindle axis 3.1 and the tool spindle axis 2.1 tension a plane E, wherein the polishing point P comprises a distance a to the plane E. The distance a relates to a direction at right-angles to the plane E. The workpiece spindle axis 3.1 and the tool spindle axis 2.1 here enclose an angle α.

Figure 2A:
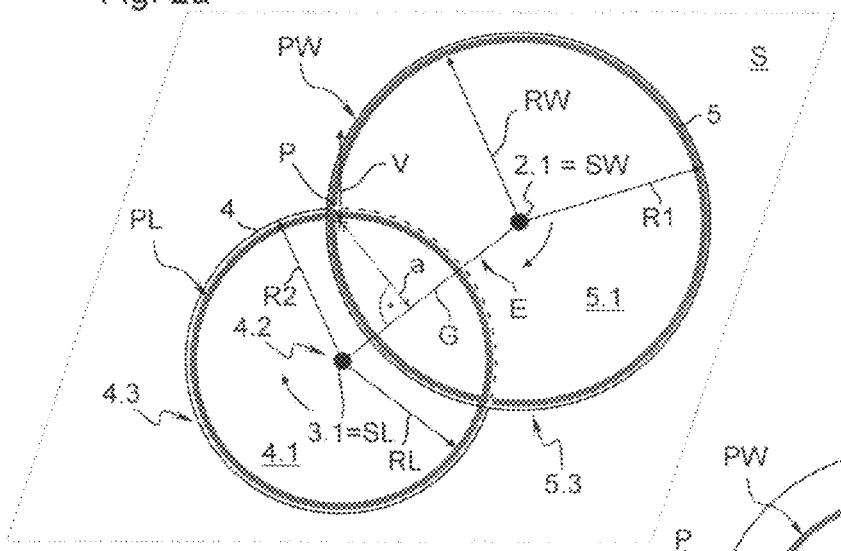
FIG. 2*a* shows a schematic diagram of the geometric proportions.
Figure 2B:
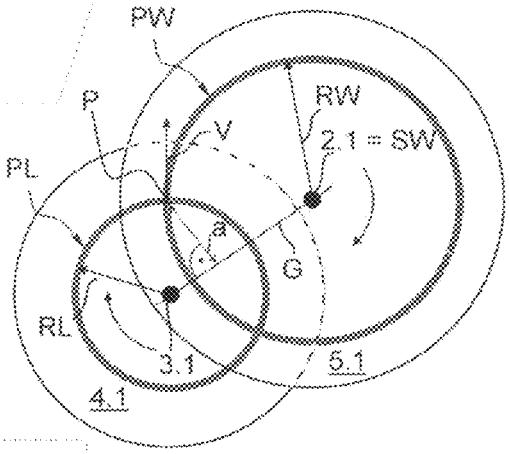
FIG. 2*b* shows a schematic diagram according to FIG. 2*a* with a changed polishing point.
Figure 2C:
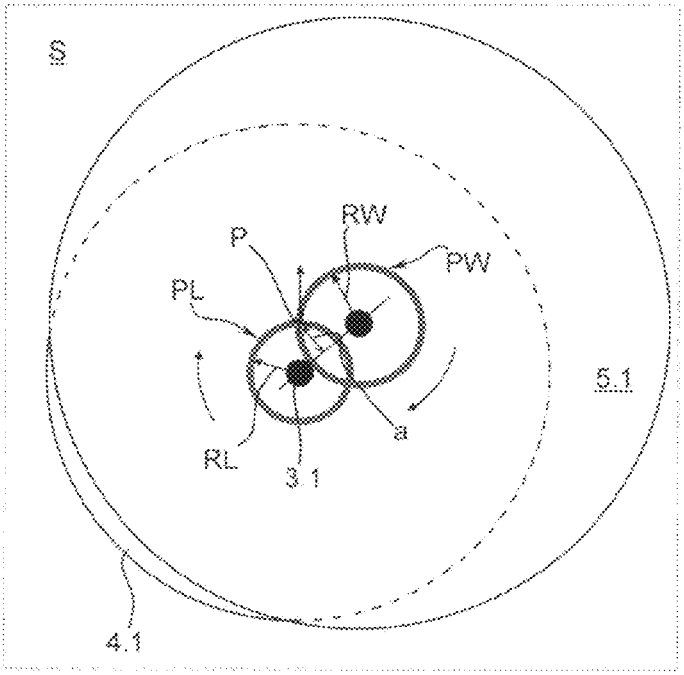
FIG. 2*c* shows an enlarged schematic diagram according to FIG. 2*b* with a changed polishing point.

In FIGS. 2*a* to 2*c*, the application proportions between the polishing head 5.1 and the lens surface 4.1 are shown in simplified form in the top view in relation to a section plane S. The polishing point P is arranged in the section plane S, wherein the section plane S sections both the workpiece spindle axis 3.1 at the section point SL and the tool spindle axis 2.1 in the section point SW. Within the section plane S, a connecting straight line G is shown between the tool spindle axis 2.1 and the workpiece spindle axis 3.1, which shows a section line between the section plane S and the plane E according to FIG. 1. The polishing point P is at the distance a from the connecting straight line G. According to the embodiment shown in FIGS. 2*a* to 2*c*, it is not absolutely necessary that the tool spindle axis 2.1 and the workpiece spindle axis 3.1 tension a plane E. The two axes can also be arranged askew to each other, wherein in all cases, the connecting straight line G is provided within the section plane S.

According to the view shown in FIG. 2*a*, the polishing zone PW on the tool side comprises a radius RW which approximately corresponds to the radius R1 of the polishing head 5. A similar principle applies to the radius RL of the polishing zone PL on the workpiece side. The radius RL also approximately corresponds to the radius R2 of the lens 4. The lens 4 is machined from the outside inwards towards the workpiece centre 4.2, starting from the edge 4.3 in relation to the progression of the polishing point P or the progression of the radius RL of the polishing zone PL, which is shown as an example in FIGS. 2*a* to 2*c* for different radii RL. The same applies accordingly to the progression of the polishing point P or the radius RW of the polishing zone PW on the tool side. The polishing point P is accordingly guided towards the tool centre or workpiece spindle axis 3.1, starting from the edge 5.3 of the polishing head 5.

Due to the distance a provided between the polishing point P and the connecting straight line G or the plane E, as explained above, the polishing head 5 or polishing area 5.1 comprises a movement vector V which runs according to FIGS. 2*a* to 2*c* in the radial direction to the lens 4. By varying the distance a, the direction of the movement vector V can be changed as required. When the distance a is zero, the movement vector V necessarily runs in the circumferential direction to the lens 4.

According to the view shown in FIG. 2*c*, which for reasons of clarity is shown in somewhat larger form than the views shown in FIGS. 2*a* and 2*b*, it can be seen that during the polishing process, the radius RL or RW of the polishing zone PL on the workpiece side or the polishing zone PW on the tool side is smaller as the polishing machining progresses, so that with the same torque remaining of the tool 5 and the workpiece 4 on the one hand, and with the same polishing pressure remaining on the other, the polishing capacity achieved overall in the polishing point P is also lower, which is advantageous particularly in the area of the workpiece centre 4.2, i.e. the centre of the lens 4.2. Both the lens 4 and the polishing area 5.1 of the polishing head 5 are machined or used over their entire area due to the polishing process described above.

Figure 3:
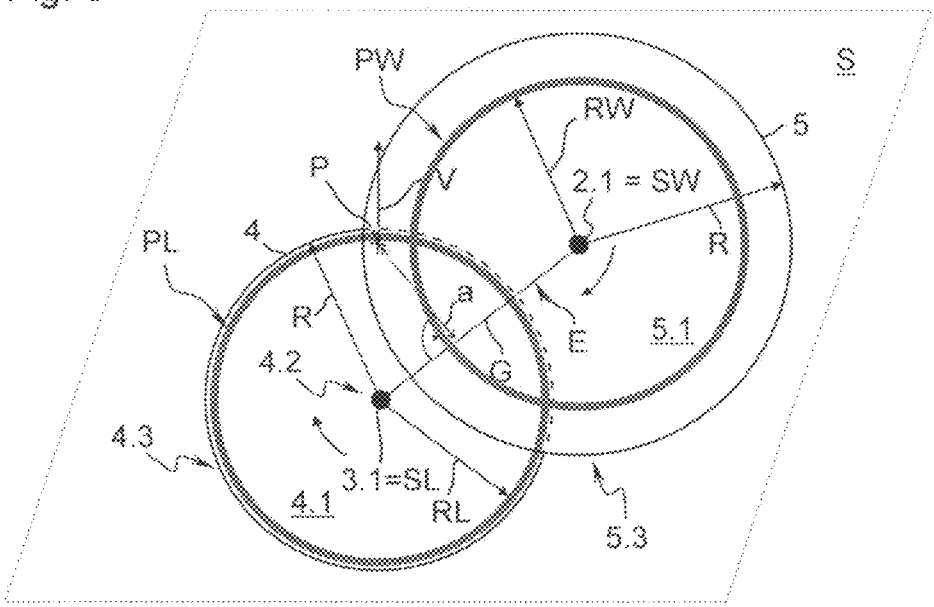
FIG. 3 shows a schematic diagram of the geometric proportions.

According to the method shown in FIG. 3, the radius RW of the polishing zone PW on the tool side is at the beginning of machining the same size as the radius RL of the polishing zone PL on the workpiece side. During machining, the radius RW and the radius RL are reduced in size to the same degree. On the workpiece side, the radius RW is reduced to zero, and on the tool side, the radius RL is reduced to 1% of the radius R1 of the polishing head, or until it is close to the tool spindle axis 2.1.

LIST OF REFERENCE NUMERALS

1 Lens polishing machine
2 Polishing spindle
2.1 Tool spindle axis
3 Tool spindle
3.1 Workpiece spindle axis
4 Lens, workpiece
4.1 Lens surface
4.2 Centre, workpiece centre, lens centre
4.3 Edge
5 Polishing head, polishing tool
5.1 Polishing area
5.3 Edge
a Distance
B1 Movement axis, translation axis
B2 Movement axis, pivot axis
B3 Movement axis, translation axis
E Plane
G Straight line, connecting straight line
P Polishing point
PL Polishing zone, lens
PW Polishing zone, tool
R1 Radius, polishing head
R2 Radius, lens
RL Radius, polishing point, polishing zone of the lens
RW Radius, polishing point, polishing zone of the tool
S Section plane
SL Section point, plane E with workpiece spindle axis
SW Section point, plane E with tool spindle axis
V Movement vector
α Angle

What is claimed is:

1. A method for polishing lens surfaces in which a polishing area of a polishing head which rotates around a tool spindle axis is guided over the lens surface to be polished of a workpiece which rotates around a workpiece spindle axis, wherein the polishing tool has a radius of curvature t and the workpiece has a radius of curvature W that is smaller than the radius of curvature t, wherein the polishing tool and the workpiece are positioned against each other in a polishing point P such that at any one time a single contact point of the polishing tool contacts a single contact point of the workpiece, comprising the steps of:

placing the single polishing point P at least outside of the workpiece centre at a distance "a" from a straight line G which connects the tool spindle axis and the workpiece spindle axis, wherein the straight line G and the polishing point P are arranged on a shared section plane S, and wherein the shared section plane S sections each of the workpiece spindle axis and the tool spindle axis in one single point each.

2. The method according to claim 1, wherein on the tool side, a main movement vector V of the polishing movement is set, and i) at least one direction component of the main movement vector V runs in the radial direction to the lens and/or ii) the direction of the main movement vector V is varied during the polishing process.

3. The method according to claim 2, wherein the polishing point P is guided on the workpiece side in the radial direction during the polishing process, from the outside inwards towards the workpiece centre.

4. The method according to claim 2, wherein the direction of a movement vector V is set in the polishing point P in such a manner that it runs in the radial direction to the workpiece from the inside outwards.

5. A lens polishing machine comprising: a polishing spindle which comprises a tool spindle axis for holding a polishing head and with a workpiece spindle which comprises a workpiece spindle axis for holding a lens to be polished, wherein the polishing head and a lens surface of the lens can be brought into contact against each other in a polishing point P such that at any one time a single contact point of the polishing head contacts a single contact point of the lens surface, wherein at least one movement axis B1 is provided, by means of which a distance a between the polishing point P and a straight line G which connects the tool spindle axis and the workpiece spindle axis can be set and/or changed, wherein the straight line G and the polishing point P are arranged on a shared section plane S, and wherein the shared section plane S sections each of the workpiece spindle axis and the tool spindle axis in one single point each.

6. The lens polishing machine according to claim 5, wherein the movement axis B1 is designed as a translation axis, and a further movement axis B2 is provided which is designed as a pivot axis, which encloses a right angle with a direction portion of the movement axis B1, wherein the movement axes B1 and/or B2 comprise a direction portion which is at right angles to the workpiece spindle axis.

7. The lens polishing machine according to claim 6, wherein a further movement axis B3 is provided which is designed as a translation axis, which comprises a direction portion, which encloses a right angle with the movement axis B1 and/or with the movement axis B2, wherein the movement axis B3 comprises a direction portion which is parallel to the workpiece spindle axis.

8. The lens polishing machine according to claim 7, wherein by means of the movement axes B1, B2 and/or B3, the distance a can be set independently of a position of the polishing point P on the tool side.

9. The method according to claim 1, wherein the polishing point P is guided on the workpiece side in the radial direction during the polishing process, from the outside inwards towards the workpiece centre.

10. The method according to claim 1, wherein the direction of a movement vector V is set in the polishing point P in such a manner that it runs in the radial direction to the workpiece from the inside outwards.

11. The lens polishing machine according to claim 6, wherein a further movement axis B3 is provided which is designed as a translation axis, which comprises a direction portion, which encloses a right angle with the movement axis B1 and/or with the movement axis B2, wherein the movement axis B3 comprises a direction portion which is parallel to the workpiece spindle axis

12. The lens polishing machine according to claim 11, wherein by means of the movement axes B1, B2 and/or B3, the distance a can be set independently of a position of the polishing point P on the tool side.

* * * * *